US008056262B2

(12) United States Patent
Lindqvist et al.

(10) Patent No.: US 8,056,262 B2
(45) Date of Patent: Nov. 15, 2011

(54) SHOE SYSTEM WITH A RESILIENT SHOE INSERT

(75) Inventors: Wilhelm Ove Lindqvist, Stockholm (SE); Hans Larsson, Mjolby (SE); Leif Lindh, Danderyd (SE); Kjell Lindh, Danderyd (SE)

(73) Assignee: Trackguard AB, Danderyd (SE)

( * ) Notice: Subject to any disclaimer, the term of this patent is extended or adjusted under 35 U.S.C. 154(b) by 790 days.

(21) Appl. No.: 12/123,552

(22) Filed: May 20, 2008

(65) Prior Publication Data

US 2008/0216350 A1 Sep. 11, 2008

Related U.S. Application Data

(63) Continuation-in-part of application No. 10/531,116, filed as application No. PCT/US03/31864 on Oct. 8, 2003, now abandoned.

(51) Int. Cl.
*A43B 13/18* (2006.01)
*A43B 13/14* (2006.01)

(52) U.S. Cl. ..... 36/28; 36/27; 36/91; 36/151

(58) Field of Classification Search ..... 36/91, 92, 36/25 R, 27, 28, 29, 37, 38, 7.8, 151, 158, 36/168, 173, 179; 623/55

See application file for complete search history.

(56) References Cited

U.S. PATENT DOCUMENTS

| | | | | |
|---|---|---|---|---|
| 324,065 | A * | 8/1885 | Andrews | 36/37 |
| 5,282,325 | A * | 2/1994 | Beyl | 36/27 |
| 5,367,790 | A * | 11/1994 | Gamow et al. | 36/27 |
| 5,396,718 | A * | 3/1995 | Schuler et al. | 36/38 |
| 5,435,079 | A * | 7/1995 | Gallegos | 36/38 |
| 5,701,686 | A | 12/1997 | Herr et al. | |
| 6,029,374 | A | 2/2000 | Herr et al. | |
| 6,247,249 | B1 | 6/2001 | Lindqvist | |
| 6,449,878 | B1 * | 9/2002 | Lyden | 36/27 |
| 6,601,042 | B1 * | 7/2003 | Lyden | 705/26.5 |
| 6,901,686 | B2 * | 6/2005 | Hayes | 36/27 |
| 6,964,119 | B2 * | 11/2005 | Weaver, III | 36/27 |
| 7,100,308 | B2 * | 9/2006 | Aveni | 36/27 |
| 7,107,235 | B2 * | 9/2006 | Lyden | 705/26.5 |
| 7,900,376 | B2 * | 3/2011 | Rabushka | 36/27 |

* cited by examiner

*Primary Examiner* — Jila Mohandesi
(74) *Attorney, Agent, or Firm* — Fasth Law Offices; Rolf Fasth

(57) ABSTRACT

A first load (L1) is put on the upper leg (606) to create a contact area (619) between the front segment (610) and the front segment (618). The contact area (619) has a center point (601) located a distance (p1) from the front end (602). An upper forward segment (621) pulls away from a lower forward segment (623) immediately adjacent to the front end (602) to create a loop (625*a*). The first load (L1) is progressively increased to a second load (L2) and the center point (601) is rolled back from the distance (p1) to a distance (p2) from the front end (602). The segments (621) and (623) expand the loop (625*a*) to a loop (625*b*).

3 Claims, 10 Drawing Sheets

SHOE SYSTEM WITH A RESILIENT SHOE INSERT

TECHNICAL FIELD

The present invention relates to a resilient shoe spring system that is integrated with a shoe system. In comparison with previous inventions within this field, it introduces progressiveness along with new features as pull and roll factors.

BACKGROUND AND SUMMARY OF THE INVENTION

Users and developers of elastic shoes and shoe soles are confronted with the problem of back injury and releasing the stored energy in the shoe sole in a manner which improves walking and running economy while at the same time achieving adequate bio-mechanical shoe stability and cushioning. Many shoe manufacturers have concentrated their effort on chock absorption by permanently increasing the thickness of the shoe sole. This has resulted in a slight change of the angle between the ankle and the foot that may weaken the tendons of the foot. This change of the angle may also lead to instability and reduced bio-mechanical effect. In addition, the focus on increasing the chock absorption within the shoe industry has led to yet another problem, namely the fact that the more cushioning put into a shoe the more energy is needed to get out of it.

Many efforts have been made to develop an effective spring mechanism for shoes or shoe soles in order to come to terms with these and other problems. However, the earlier proposed spring designs for shoe soles have not been satisfactory. Despite many elaborate shoe sole solutions, back injuries and other injuries are still common due to poorly designed shoes. Injuries due to poor shoe designs are common in sports and a variety of work activities.

The method and shoe system of the present invention provide a solution to the above-mentioned problems. For instance will it not only provide sufficient chock absorption/cushioning in order to protect users from injuries related to the stresses of prolonged standing, walking and running. It will also, by its function of storing up energy, provide sufficient energy to heave up the user out of the cushioning, i.e. it does not only absorb energy, it also gives back energy. Furthermore, it does so without risking almost immediate fatigue failure of the resilient shoe insert which is the case with corresponding non-progressive inventions. More particularly, the method is for using a shoe system having a resilient shoe insert. A shoe has a shoe insert disposed inside the shoe. The insert has an upper leg and a lower leg connected by a front end with a curvature. The upper and lower legs 506 have a concave segments and end points. A load is put on the insert to compress the end points towards one another. This shortens the effective length of the legs because the legs are in contact at a contact segment. This makes the insert stiffer the more it is compressed. The effective length of the legs is shorter at the outside compared to the inside so that the outside is stiffer than the inside.

Last but not least, at first glance the present progressively resilient shoe insert may look similar to previous non-progressive ones, but it is not. The closer one looks the lesser resemblances, especially when it comes to functions and qualities. For the sake of clarity, even if it may be crude, one could compare with early days of aviation. It was the shape that was the secret then. Without the wave-profile of the wings, there was no way of taking-off with the airplane. One could say the same about the present invention, at least in a transferred sense. It is the specific and unique wave-shape of the present invention that makes all the difference.

DETAILED DESCRIPTION

Figure 1:
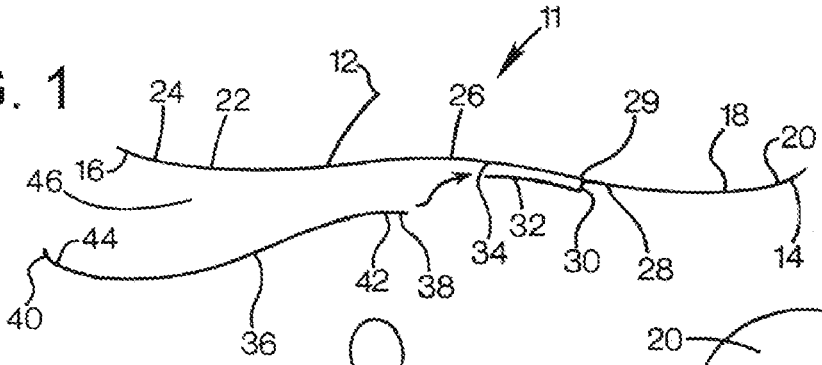
FIG. 1 is a side view of a shoe insert of the present invention.

With reference to FIGS. 1-8, the present invention is a shoe system 10 having a resilient shoe insert 11 including a stiff first support member 12 that may be made of a carbon fiber reinforced composite material or any other suitable material that is relatively stiff. The first member 12 has a flexible and bendable fore end 14 and a stiff aft end 16. The fore end 14 has a cavity portion 18 that terminates in a slightly upwardly curved end section 20. It is to be understood that the fore end is preferably made of a flexible and bendable material that may be cut to size by a pair of scissors to tailor the shape of the fore end 14 to the shape of the shoe system and the foot. Another reason for using the flexible material at the fore end 14 is so that the toes of the foot may fully cooperate with the fore end 14 when walking and moving about.

The stiff aft end 16 has a cavity portion 22 that terminates in a slightly upwardly curved end section 24. A stiff middle section 26 of the member 12 is convex shaped relative to the concave cavity portions 18, 22. A holder mechanism 26 is attached to an underside 28 of the first member 12. The holder mechanism 26 includes a short end wall 30 that is perpendicular to the member 12 and a long support wall 32 that is perpendicularly attached to the end wall 30 to that the underside 28, the end wall 30 and the support wall 32 define a receiving pocket 34 that is facing the aft end 16. Preferably, the end wall 30 is attached to the underside 28 on the first member 12 at a point 29 that is at a front-end portion of the middle section 26. In the preferred embodiment, the first member 12 is stiff all the way from the place of attachment at the point 29 of the end wall 30 to the end section 24 and bendable from the point 29 to the end section 20.

A second member 36 has a fore end 38 that is insertable into the receiving pocket 34. More particularly, the second member has the fore end 38 and an opposite aft end 40. The fore end 38 has a slightly downwardly curved end section 42 and the aft end 40 has an upwardly curved end section 44 so that the second member 36 is somewhat S-curved. When the second member 36 is inserted into the receiving pocket 34, the end section 44 is aligned with the end section 24 of the first member 12 so that a gap 46 is formed between the first member 12 and the second member 36.

Figure 6:
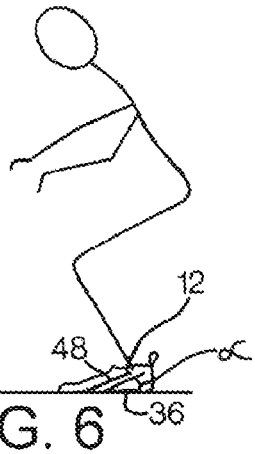
FIG. 6 is a side view of a person standing on the shoe and leaning forward.
Figure 5:
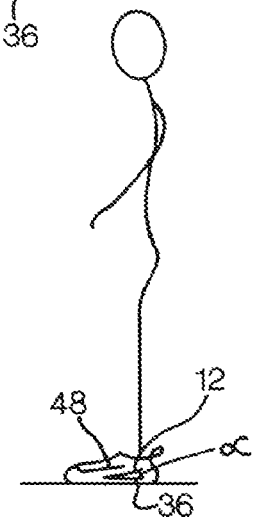
FIG. 5 is a side view of a person standing straight up on the shoe of the present invention.

An important feature of the present invention is that the second member 36 is springy and resilient while the first member 12 is generally stiff except for a bendable toe portion. As is explained below, a heavier person may select a stiffer second member than a lighter person to prevent the second member 36 from abutting or resting against the first member 12 when the heavier person is standing on the first member 12 with the second member 36 inserted into the receiving pocket 34. Preferably, the second member 36 should be sufficiently stiff so that the second member 36 does not bottom out even though the person is actively using the shoe insert 11 disposed in the shoe. For example, when a person is standing straight up (as is shown in FIG. 5) so that the shoe insert 11 is subjected to the greatest weight, the first member 12 form a minimum angle alpha relative to the second member 36 but the angle should not be zero. The angle alpha increases when the person bends his/her knees or leans forward, as is shown in FIG. 6, so that an increasing amount of the body is supported by the front portion of the foot and less weight is exerted upon the second member 36. It is also preferred that the stiffness and the shape of the second member 36 are such that the first member 12 does not bottom out even though the person is jumping or actively using a shoe 48.

Other factors that determine what stiffness to use for the second member 36 include the type of activity the shoe is going to be used for and whether the walking/running surface is hard, soft and uneven. The shape of the second member 36 may also be varied depending on the needs of the user. For example, a second member having a more bent fore end creates a bigger gap 46 between the second member and the first member when the second member is inserted into the holder 32. A bigger gap 46 may reduce the risk of bottoming out and also changes the angle between the foot and the ankle.

Because the first member 12 is stiff, the shape of the first member is maintained and the foot is provided a full support although the second member 36 may move relative to the first member 12. In other words, the first member 12 provides good support to the foot although the second member 36 may be compressed against the first member 12 and later permitted to move back to the relaxed expanded position depending upon how the shoe is used in, for example, a sport activity.

Figure 2:
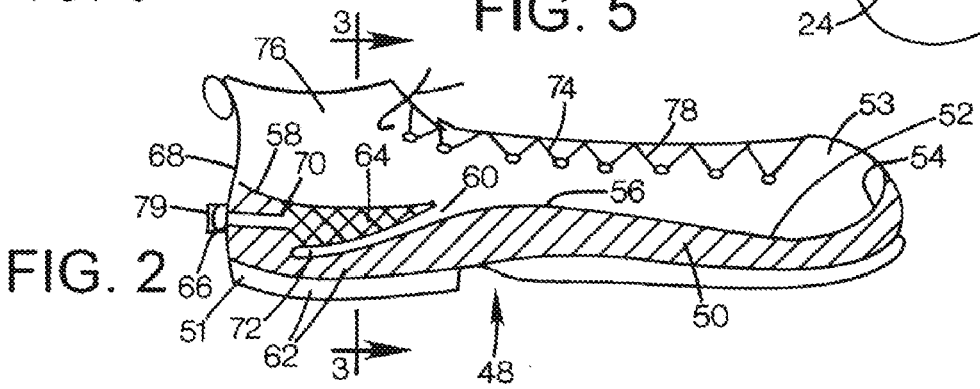
FIG. 2 is a side view of a shoe adapted to receive the shoe insert of FIG. 1.

As best shown in FIG. 2, the shoe 48 may have a preformed shoe sole 50 that has an upper surface 52 that is shaped to snugly receive the shoe insert 11. The shoe 48 has a heel section 51 and a toe portion 53. The shoe sole 50 is preferably made of a flexible material such as rubber or plastic. The upper surface 52 has an upwardly curved front portion 54, a convex middle portion 56 and a slightly upwardly curved aft portion 58 to support the sections 20, 26 and 24, respectively, of the first member 12.

An important feature is that the shoe sole defines an angular curved groove 60 that is dimensioned to receive the second member 36. The groove 60 extends backwardly and angularly downwardly towards a heel 62 of the shoe 48. A triangular wedge 64 is disposed between the upper surface 52 and the groove 60. The wedge 64 is removably attached to the sole 50 so that the wedge 64 easily be removed to make it convenient to insert and remove, particularly, the second member 36 of the shoe insert 11. The wedge 64 is made of a very flexible material so when the second member 36 is urged towards the first member 12 by the weight of the user, the wedge 64 is deformed and compressed accordingly.

The shoe 48 may also be used with the shoe insert 11 placed on the upper surface 52 but with the wedge 64 removed. An one-way valve 66 is attached to a back end 68 of the shoe 48. A channel 70 may be defined in the shoe sole 50 so that the valve 66 is in fluid communication with a space 72 that is formed between the first member 12 and the second member 36. Of course, the wedge 64 may extend all the way back to the section 58 of the shoe sole 50 so that there is no need for a channel.

When the second member 36 is pressed towards the first member 12 so that the shoe insert 11 is in a compressed position, an over pressure is formed in the space 72 that may flow into the channel 70 and out through the valve 66 to provide good mechanical ventilation inside the shoe. Any under pressure that may be formed in the space 72 when the second member 36 is permitted to move from the compressed position back to its original expanded position away from the first member 12 may be equalized by sucking in air from an upper part 74 of the shoe 48 such as the opening 76 or the open areas adjacent to the shoe laces 78. It should be understood that the valve 66 may also be a two-way valve so that the valve may be used to compensate for both over-pressure and under-pressure in the space 72. In this way, the valve 66 may function to circulate and possibly bring in or suck cool air into the inside of the shoe when the second member 36 is permitted to expand from the compressed position. A filter 79 may also be placed in the valve 66 to prevent dust and other undesirable particle from entering into the inside of the shoe 48 when the shoe inlet 11 is expanding.

Figure 3:
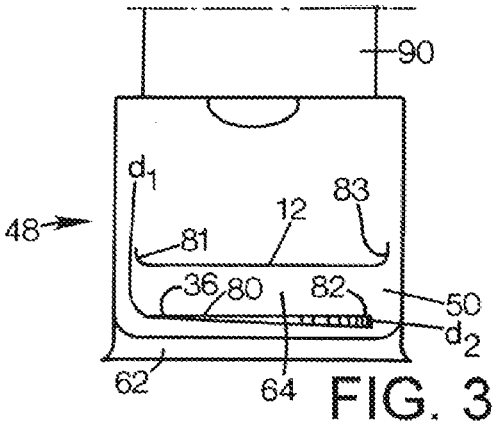
FIG. 3 is a rear view of the shoe in a vertical position along line 3-3 of FIG. 2 with the shoe insert of FIG. 1 placed inside the shoe.
Figure 4:
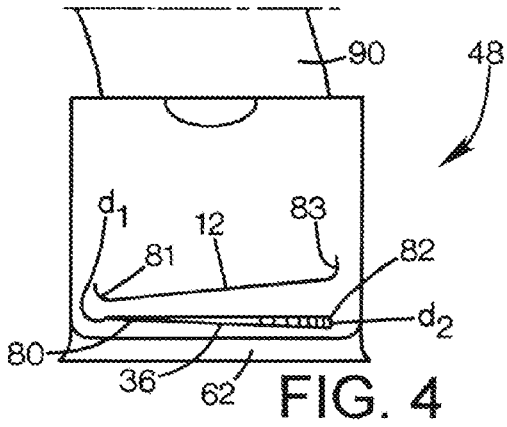
FIG. 4 is a rear view of the shoe along line 3-3 of FIG. 2 when the ankle is disposed in an inwardly sloping position.

As best shown in FIG. 3, the first member 12 and the second member 36 are substantially parallel when a person is standing straight up without leaning sideways. The first member 12 may have vertical sidewalls 81, 83 to prevent the foot from sliding sideways and put undue pressure on the sidewall of the shoe. However, when the person moves in a sideways direction so that an ankle 90 is in an inclined position, the weight distribution of the shoe may be uneven, as shown in FIG. 4, so that the second member 36 is twisted slightly relative to the stiff first member 12 to create a torsion force about an outside portion 82 of the second member 36. The second member 36 may have a first thickness $d_1$ on an inside portion 80 and a second thickness $d_2$ on the outside portion 82. The second thickness $d_2$ is greater than the first thickness $d_1$ so that the second member 36 is only permitted to twist relative to the stiff first member 12 when the ankle 90 is leaned inwardly, as shown in FIG. 4, if the shoe 48 shown is a shoe for the right foot. In other words, the second thickness at the outside portion 82 is sufficiently thick to make the outside portion 82 of the second member 36 rigid enough to prevent any relative movement between the first member 12 and the second member 36 at the outside portion 82. Because the inside portion 80 is twistable, there is less need to bend the ankle relative to the foot, thus exposing the ankle to less strain, when the person is standing with the legs wide apart. For example, it is common to stand with the legs wide apart when waiting to return a serve in tennis. Another situation that may put extra strain on the ankle is when running along a surface that is sloping sideways. The twisting of the inside portion 80 generally results in less risk of straining the foot because the angle change between the ankle and the foot as a result of leaning the ankle inwardly is reduced.

Figure 7:
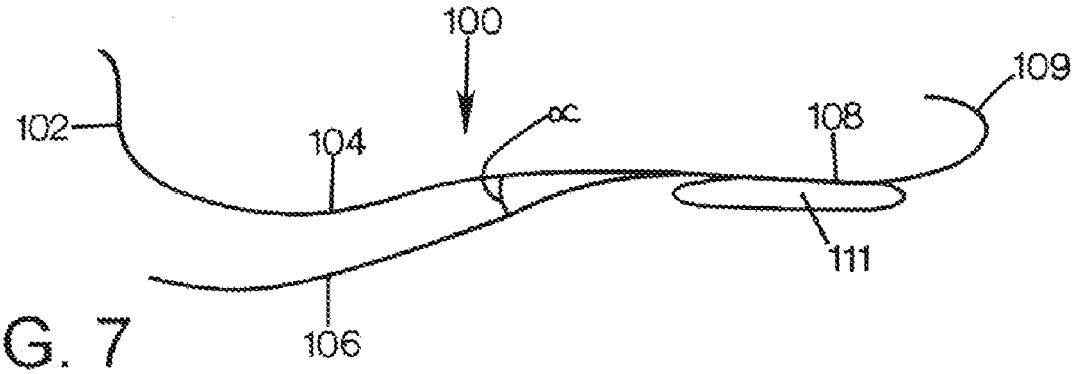
FIG. 7 is a side view of an alternative embodiment of the shoe insert of the present invention.

FIG. 7 shows an alternative embodiment of the present invention. The shoe insert 100 includes an extended back support section 102 that extends above the heel of the foot to partly protect the Achilles tendon and the heel of the foot. The support section 102 reduces any excessive rubbing between the heel of the foot and the rear inside wall of the shoe. Excessive rubbing may cause blisters as the shoe insert 11 is compressed and expanded. Similar to the shoe insert 11, the shoe insert 100 has a stiff first member 104, a resilient second member 106 and a bendable and flexible fore end 108 that may terminate at a toe portion 109 that extends over the toes of the foot to protect the toes while the toe portion 109 may follow the movement of the shoe insert. A resilient rubber pad may be adhered to a bottom side of the fore end 108 to provide extra comfort. The first member 104 and the second member 106 form an angle alpha therebetween. This embodiment is particularly useful for working shoes and other types of heavy-duty boots.

Figure 8:
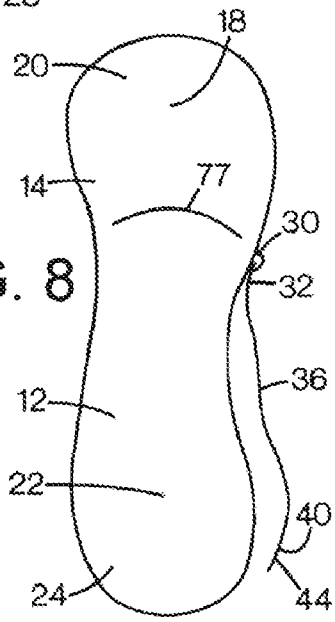
FIG. 8 is a top view of the shoe insert.

As best shown in FIG. 8, a transition area 77 between the first member 12 and the soft and flexible fore end 14 may be a curved section that is formed according to the support area of the foot that is disposed behind the toes.

Figure 9:
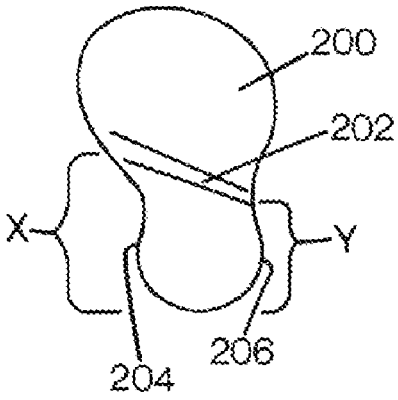
FIG. 9 is a top view of a second embodiment of a shoe insert for the right shoe.
Figure 10:
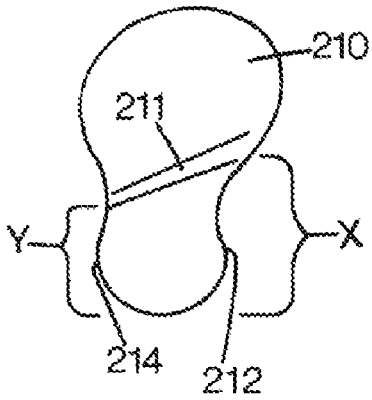
FIG. 10 is a top view of the second embodiment of the shoe insert for the left shoe.
Figure 11:
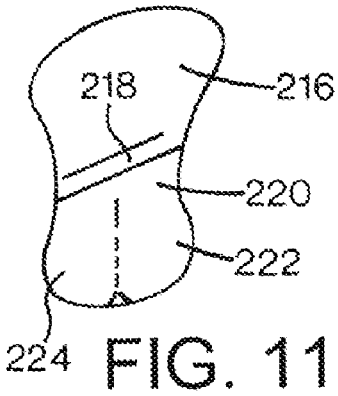
FIG. 11 is a bottom view of a third embodiment of a shoe insert.

FIG. 9 is a top view of a second embodiment of the shoe insert of the present invention. A shoe insert 200 has a transition area 202 (that is equivalent to the transition area 77 of FIG. 8) that extends at an angle so that a distance (x) at an inside 204 of the shoe insert 200 is longer than a distance (y) at an outside 206. In other words, the flexible member is longer at the inside 204 than the outside 206 so that the inside 204 may flex (as shown in FIG. 4) while the outside 206 is relatively stiff. Similarly, FIG. 10 shows a top view of a shoe insert 210 for the left shoe that has a transition area 211 and an inside 212 that has a length (x) that is longer than a length (y) of an inside 214. FIG. 11 is a bottom view of a third embodiment of the present invention.

Figure 12:
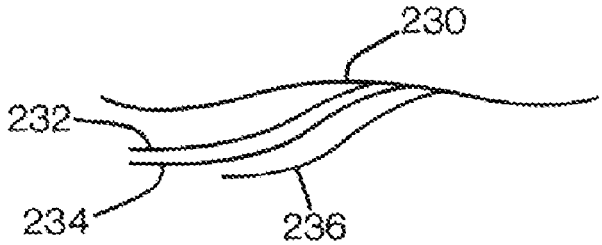
FIG. 12 is a side view of a fourth embodiment of a shoe insert.

A shoe insert 216 has an angular transition area 218 in addition to a flexible member 220 that has a softer inside portion 222 and a stiffer outside portion 224. In the third embodiment, it is not necessary that the transition area extends at an angle because the inside portion 222 is already softer than the outside portion 224. FIG. 12 is a side view of a shoe insert 230 having a plurality of flexible members 232, 234, 236 attached to an underside 238 of the shoe insert 230 so that both the resiliency and the resiliency on the inside and the outside may be adjusted to the specific needs of the user of the shoe insert 230.

Figure 14:
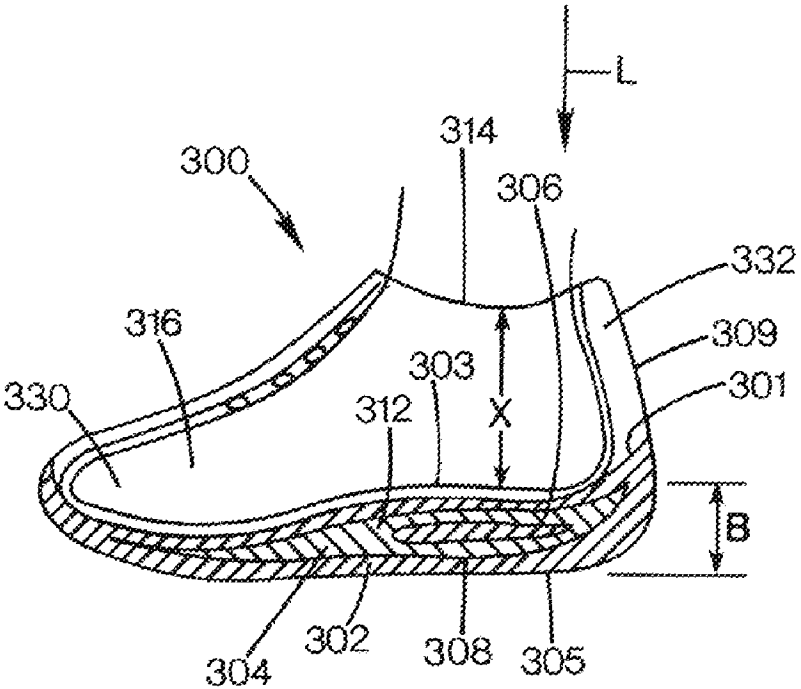
FIG. 14 is a side view of the fifth embodiment of the shoe insert in a compressed position.
Figure 13:
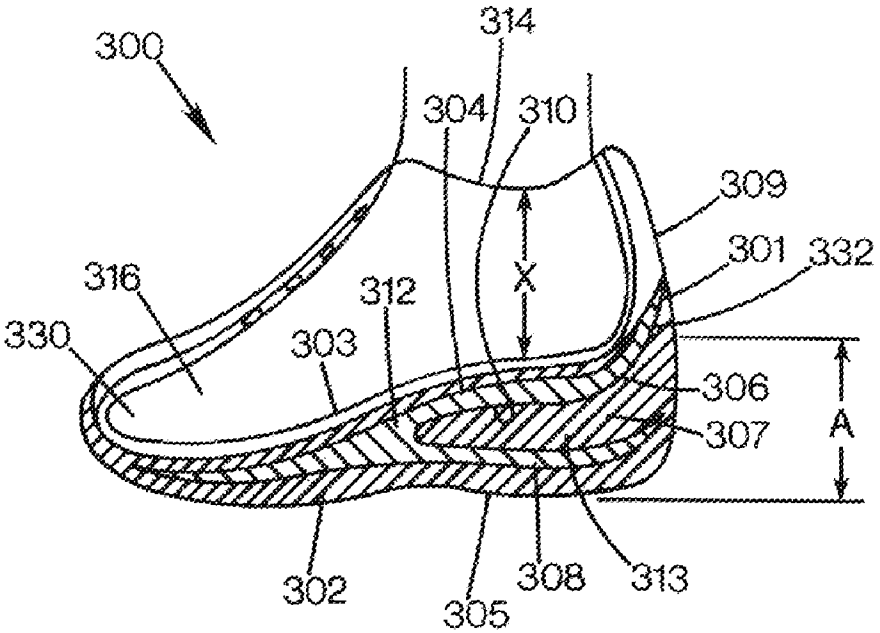
FIG. 13 is a side view of a fifth embodiment of a shoe insert integrated with a shoe sole.

FIGS. 13 and 14 show a fifth embodiment of the present invention. A shoe 300 has a shoe sole 302 including an upper layer 303 with a shoe insert 304 integrated with or built into the sole 302. The shoe 300 has a toe portion 330 and a heel portion 332 and shoe sole 302 has a bottom side 305. The insert 304 has a relatively stiff upper segment 306 and a bendable lower segment 308 that is attached to a lower side 310 of the segment 306 at a mid-section 312 of the upper segment 306. The segment 306 is, preferably, attached to a back piece 301 that is disposed at the upper segment 303 adjacent to a backside 309 of the shoe 300. The upper segment 306 and the lower segment 308 have a space 307 defined therebetween. The space 307 may be filled with air or a very compressible and expandable material. The space 307 may be completely or partially filled with a material. For example, the material may include segments of an elastomeric material to change the spring characteristics of the insert 304. Stiffer elastic segments may be used if the person is heavy and less segments or less stiff segments may be used if the person is relatively light.

An important feature is that the segment 306 is stiff and is attached to the sole so that the segment 306 does not move relative to the shoe although the lower segment 308 may move relative to the upper segment 306. This means that a foot inserted into the shoe 300 remains in the same position regardless of the flexural movements of the lower segment 308. When the lower segment 308 is in an expanded unloaded position (see FIG. 13) the distance between the upper segment 306 and a bottom side 305 of the sole 302 is a distance (A). However, when the shoe 300 is put under a load (L) (see FIG. 14), the lower segment 308 moves into a compressed position towards the upper segment 306 to reduce the distance between the upper segment 306 and the bottom side 310 to a distance (B) that is smaller than the distance (A). When the lower segment 308 is in the compressed position, the segment 308 urges the upper segment 306 upwardly into the expanded position.

An important feature of the present invention is that upper segment 306 is disposed at a distance (X) from an upper rim 314 both when the lower segment 308 is in the expanded position, as shown in FIG. 13, and in the compressed position, as shown in FIG. 14. This means that there is little risk of blisters on a foot 316 placed in the shoe 300 between there is no relative movement between the foot 316 and the shoe 300.

Figure 15A:
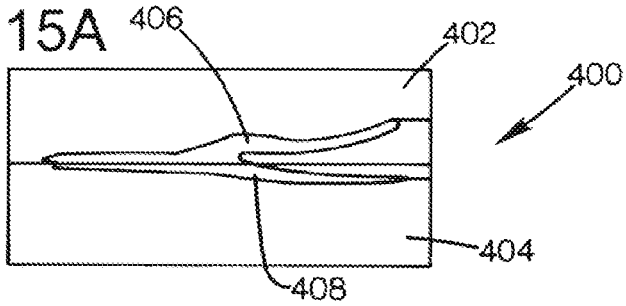
FIGS. 15A-D are schematic flow diagrams of a pressing technique for manufacturing the shoe insert.
Figure 15B:
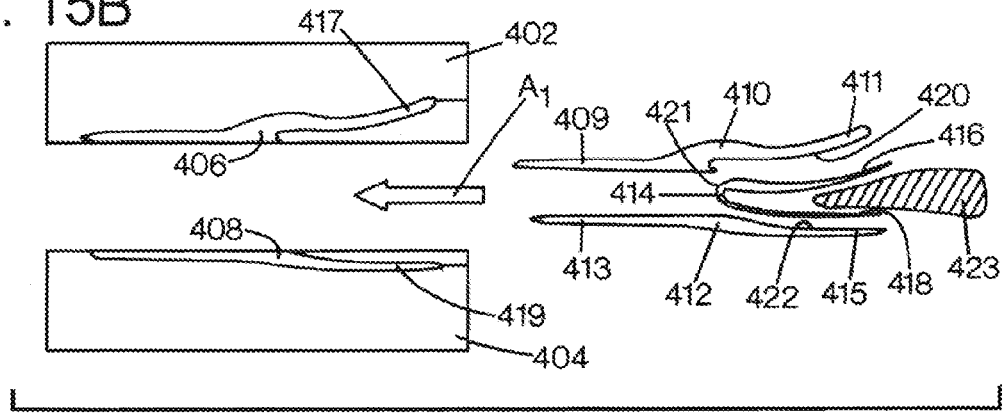

With reference to FIGS. 15A-D, the shoe insert of the present invention is preferably made by using a unique pressing method. The method relies on a tool 400 having a upper component 402 and a lower component 404. The component 402 has a cavity 406 defined therein that has the same shape as the upper segment 306 and the component 404 has a cavity 408 defined therein that has the same shape as the lower segment 308. As best shown in FIG. 15B, the components 404, 406 are separated from one another. A pre-impregnated upper component 410 is placed, as shown by an arrow A1, inside the cavity 406. The component 410 has an elongate front-end portion 409 and an elongate back end portion 411 and a shape that is similar to the shape of the cavity 406. A pre-impregnated lower component 412 is placed in the cavity 408 and has a shape that is similar to the shape of the cavity 408. Preferably, the components 410, 412 and 414 are made of polymer composites such as carbon and/or glass fiber reinforcements that are impregnated with a suitable resin. The components may be fully or partly impregnated. Preferably, the toe portions of the components 410, 412 are partially impregnated to obtain an increased bendability. The resin could be a suitable thermoplastic, such as thermoplastic polyester, or a thermoset resin, such as epoxy. Of course, other suitable polymers can also be used.

The component 412 has an elongate front-end portion 413 and an elongate back portion 415. A U-shaped third component 414 is placed between components 410, 412 to improve the physical properties of a finished insert 424. The component 414 has continuous fibers extending along the entire component 414 from one end of the U-shaped component to an opposite end of the component 414. Surprisingly, the component 414 substantially reduces fiber breakage and other failure characteristics of the insert 424. Preferably, a sandwich construction is used so that the stiffer carbon fibers may be placed on each side of the U-shaped component 414 that is, preferably, made of the less stiff glass fibers. Glass fibers have better springing characteristics compared to carbon fibers due to the high fatigue resistance properties of glass fibers. In general, glass fibers are not as brittle as carbon fibers. Carbon fibers may be used to partially or fully in the components 410, 412. However, carbon fibers may also be used on the inside of the component 414 in the form of carbon fiber tapes that extend from a back portion 411, 415, respectively, of the components 410, 412 towards a bottom 421 of the component 414. More particularly, the component 414 has the bottom 421, an upper leg 416 and a lower leg 418. The upper leg 416 is placed along an inside 420 of the back end portion 411 and the lower leg 418 is placed along an inside 422 of the back portion 415. In this way, both the upper leg 416 and the end portion 411 are placed inside an elongate back end 417 of the cavity 406 and the both the lower leg 418 and the back end portion 415 are placed inside an elongate back end 419 of the cavity 408. This means that the above described sandwich construction may be used on the legs 416, 418 of the components 410, 412 together with the component 414. Preferably, the sandwich construction is not used for the portions 409, 413. A resilient filler piece 423 may be placed between the legs 416, 418 prior to compression of the tool. The hardness of the piece 423 may be adjusted depending upon the weight of the user. For example, a more rigid piece 423 may be used if the user is heavy and a softer piece 423 may be used if the user is relatively lightweight.

Figure 15C:
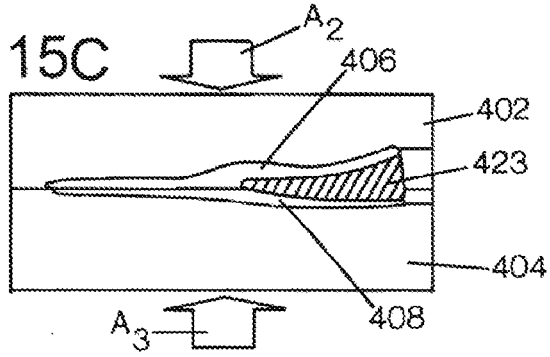

As best shown in the FIG. 15*c*, when the components 410, 412 with the third component 414 placed therebetween, are properly positioned in the tool components 402, 404, the components 402, 404 are moved towards one another, as shown by arrows A2 and A3. A pressure of between 2-40 bar is applied to the components 402, 404 for several minutes and the temperature is raised to between 100-250° C. to enable the resin of the components 410, 412 to enable a thermoplastic resin to melt or a thermoset resin to cure. The tool 400 may then be rapidly cooled before the components are removed from the tool 400.

Figure 15D:
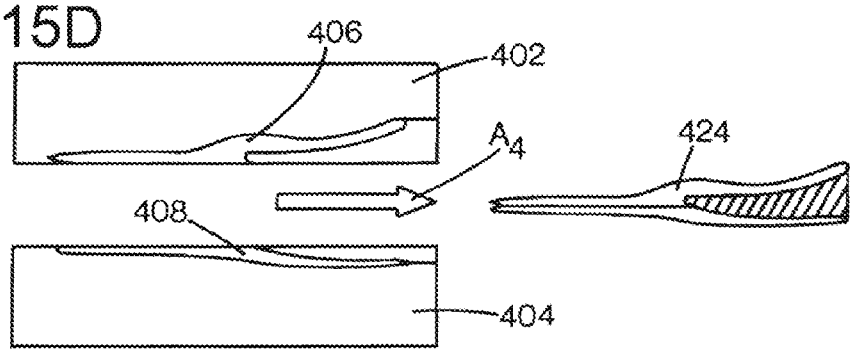

When the components 410, 412, 414 are cured into an integrated shoe insert 424, the tool components 402, 404 are separated from one another and the insert 424 is removed from the components 402, 404, as shown by an arrow A4 in FIG. 15D. The insert 424 is now ready to be integrated with or built into a shoe sole as the insert 304 is shown in FIGS. 13-14.

Figure 16:
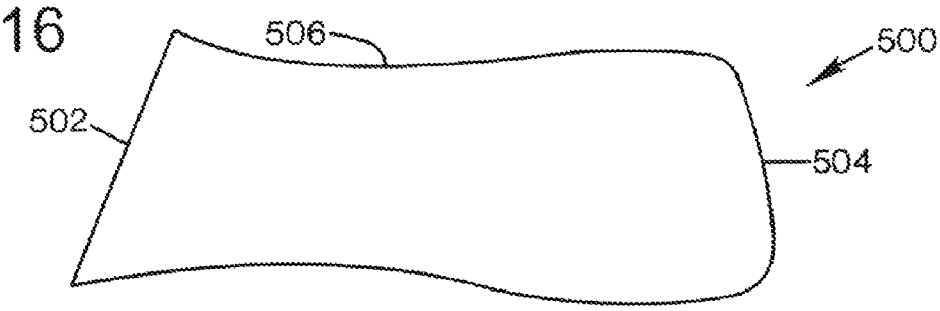
FIG. 16 is a top view of a sixth embodiment of the shoe insert of the present invention.

FIG. 16 shows a sixth embodiment of a resilient shoe insert 500 of the present invention. The insert 500 may also be placed inside the shoe 300, as shown in FIGS. 13-14, and replace the insert 304 placed inside the shoe 300. The insert 500 has a slanted straight front-end 502, a rounded back end 504 and a narrow mid-section 506. The insert 500 may be made of a composite material such as continuous fibers that extend from the back end 504, such as from the outer end 520, around the front end 502 and back to the back end 504, such as to the outer end 522. The fibers may also merely extend from the back end to the front end.

Figure 17A:
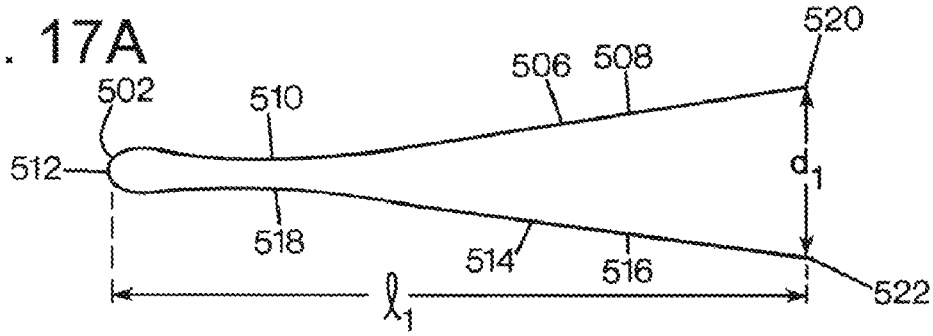
FIG. 17*a* is a side view of the sixth embodiment in a relaxed non-compressed position.
Figure 17B:
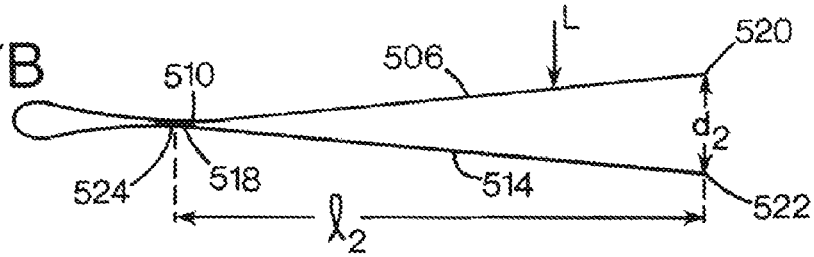
FIG. 17*b* is a side view of the sixth embodiment in a semi-compressed position so that the upper leg is in contact with the lower leg.
Figure 17C:
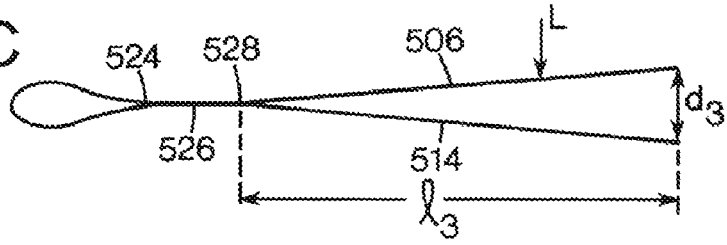
FIG. 17*c* is a side view of the sixth embodiment in a compressed position.

With reference to FIGS. 17*a-c*, the shoe insert 500 has an upper leg 506 with a straight upper leg segment 508 that terminates in a concave upper segment 510. The leg segments 508, 516 may also be slightly concave. Preferably, the segments 508, 516 are less concave than the segment 510. The segment 510 extends to the front-end 502 that is an attachment segment 512. The segment may be a curved or pointed segment or any other suitable shape and the present invention is not limited to a curved or pointed segment. The insert 500 has a lower leg 514 with a straight lower leg segment 516 that terminates in a concave lower segment 518 that is adjacent to the concave upper segment 510. The segment 518 extends to the front end 502. In this way, the fibers of the insert 500 may extend from the upper leg 506 around the curved segment 512 to the lower leg 514. The upper leg 506 has an upper end point 520 and the lower leg 514 has a lower end point 522 that is separated by a distance d1 from the upper end point 520 when the insert 500 is not compressed, as shown in FIG. 17A. The insert has an effective length 11 that extends from the front end 502 to the end points 520, 522. It is to be understood that the shape of the legs 506, 514 may be straight, concave, convex or any suitable shape and the stiffness of the legs 506, 514 may be the same or the stiffness of the leg 506 may be different from the stiffness of the leg 514.

FIG. 17B shows the insert 500 in a semi-compressed position so that the concave upper segment 510 is in contact with the concave lower segment 518 in a contact segment or point 524. The distance between the end points 520, 522 is reduced from the distance d1 to the distance d2 that is shorter than the distance d1. The effective length of the upper leg 506 and the lower leg 514 is reduced from the length 11 to the length 12 that is shorter than the length 11. The effective length 12 extends from the points 520, 522 to the contact segment 524.

FIG. 17C shows the insert 500 in a compressed position so that the upper leg 506 and the lower leg 514 is in contact over an extended area 526 that starts at the contact point 524 and extends backwardly to a separation point 528. The contact may extend all the way back to the end points 520, 522 when the insert is subjected to a sufficiently large load L. The distance between the end point 520 and the end point 522 is reduced from the distance d2 to a distance d3 that is shorter than the distance d2. The effective length of the legs 506, 514 is reduced from the length 12 to the shorter length 13. Preferably, the insert 500 is placed inside a shoe, as shown in FIGS. 13 and 14, so that a person using the shoe may compress the insert 500 as shown in FIGS. 17A-C.

Figure 18:
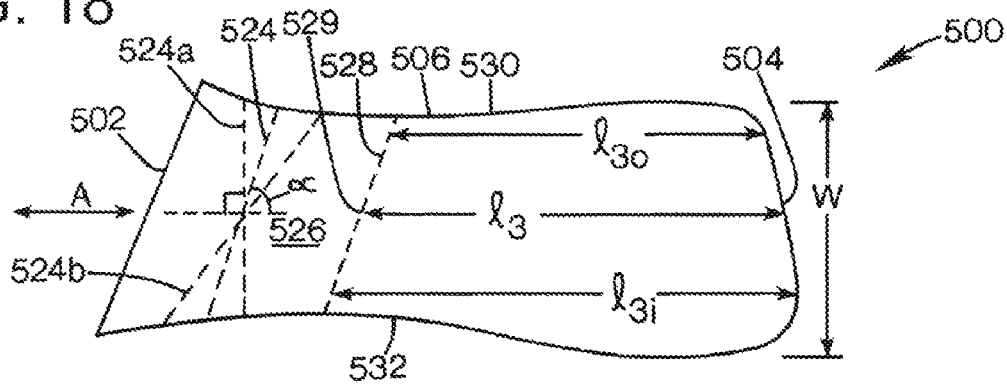
FIG. 18 is a top view of the sixth embodiment showing the varied effective lengths of the leg members.

FIG. 18 is a top view of the insert 500 and shows that the effective length of the leg on a first side, such as an outside 530, is shorter than the effective length of the leg on a second side, such as an inside 532, of the insert 500. As indicated earlier, the front-end 502 and the contact segment 524 are slanted at an acute angle alpha compared to the longitudinal direction L of the shoe insert. The effective length 13 therefore varies along the width W of the shoe insert. The effective length $l_{3o}$ on the outside 530 is shorter than the effective length $l_{3i}$ on the inside 532. This makes the outside 530 of the insert 500 stiffer than the inside 532 similar to the embodiment shown in FIGS. 9 and 10. The stiffer outside makes the insert 500, and thus the shoe, more stable. Also, the shorter the effective length $l_2$, $l_3$ of the legs, the stiffer the insert 500 becomes. In this way, the stiffness is not only varied by putting load on the insert 500 but the stiffness is also varied along the width of the separation segment 528. The angle between the segment 524 and the longitudinal axis L may be varied as shown by the contact segments 524*a* and 524*b*. Preferably, the insert 500 is removable and replaceable from the shoe system should the user need different stiffness characteristics of the insert 500.

Figure 19:
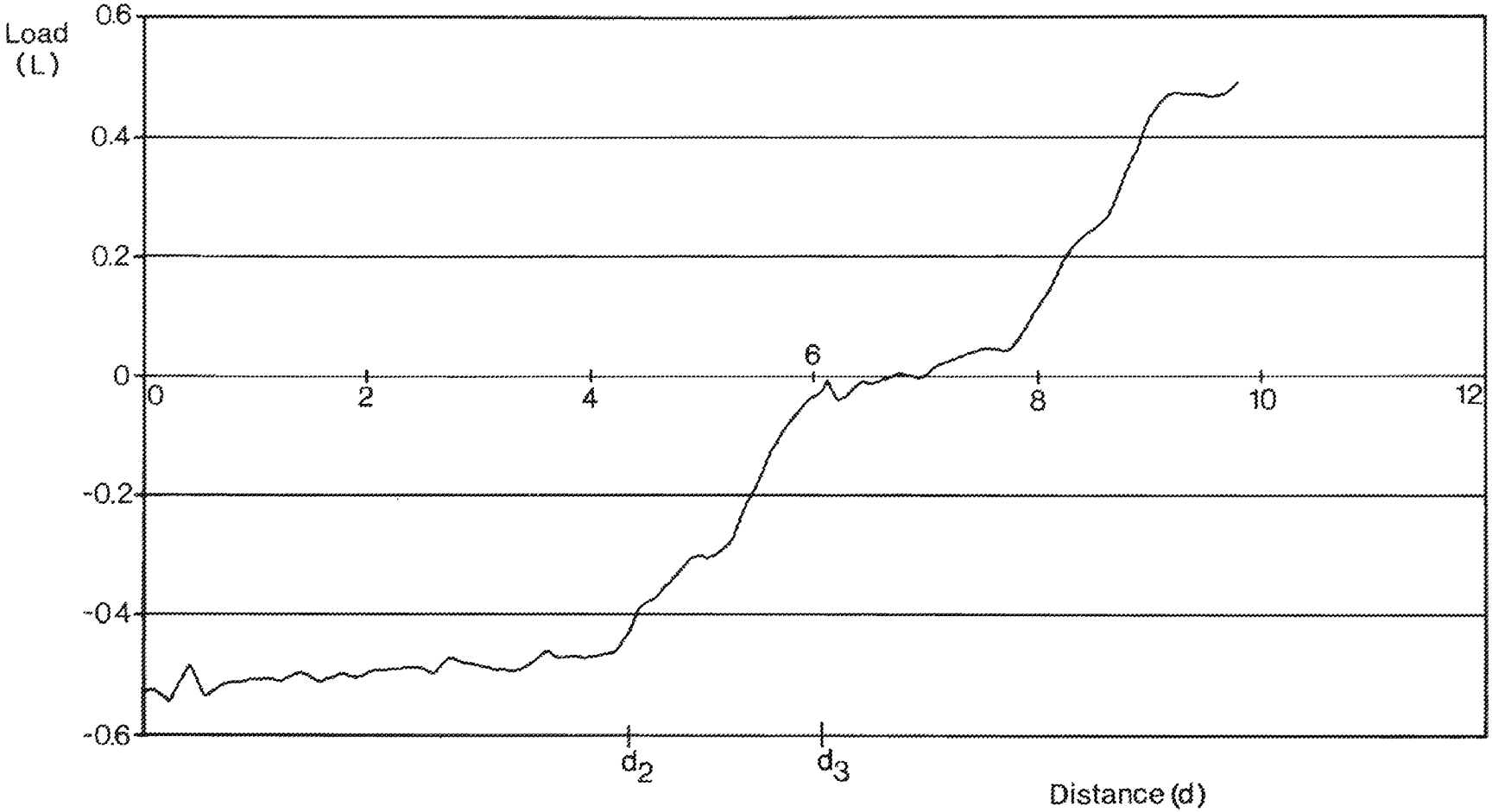
FIG. 19 is a schematic graphic illustration of a load L on the shoe insert of the present invention.

FIG. 19 is a schematic graphic illustration of the load L on the x-axis and the distance d on the y-axis. The surprising increase in load L that is required to further reduce the distance d2 to the smaller distance d3. Very little load L is required to reduced the distance to d2. However a significant load increase is required to further reduce the distance to d3. The relationship is not linear but exponential.

Figure 20A:
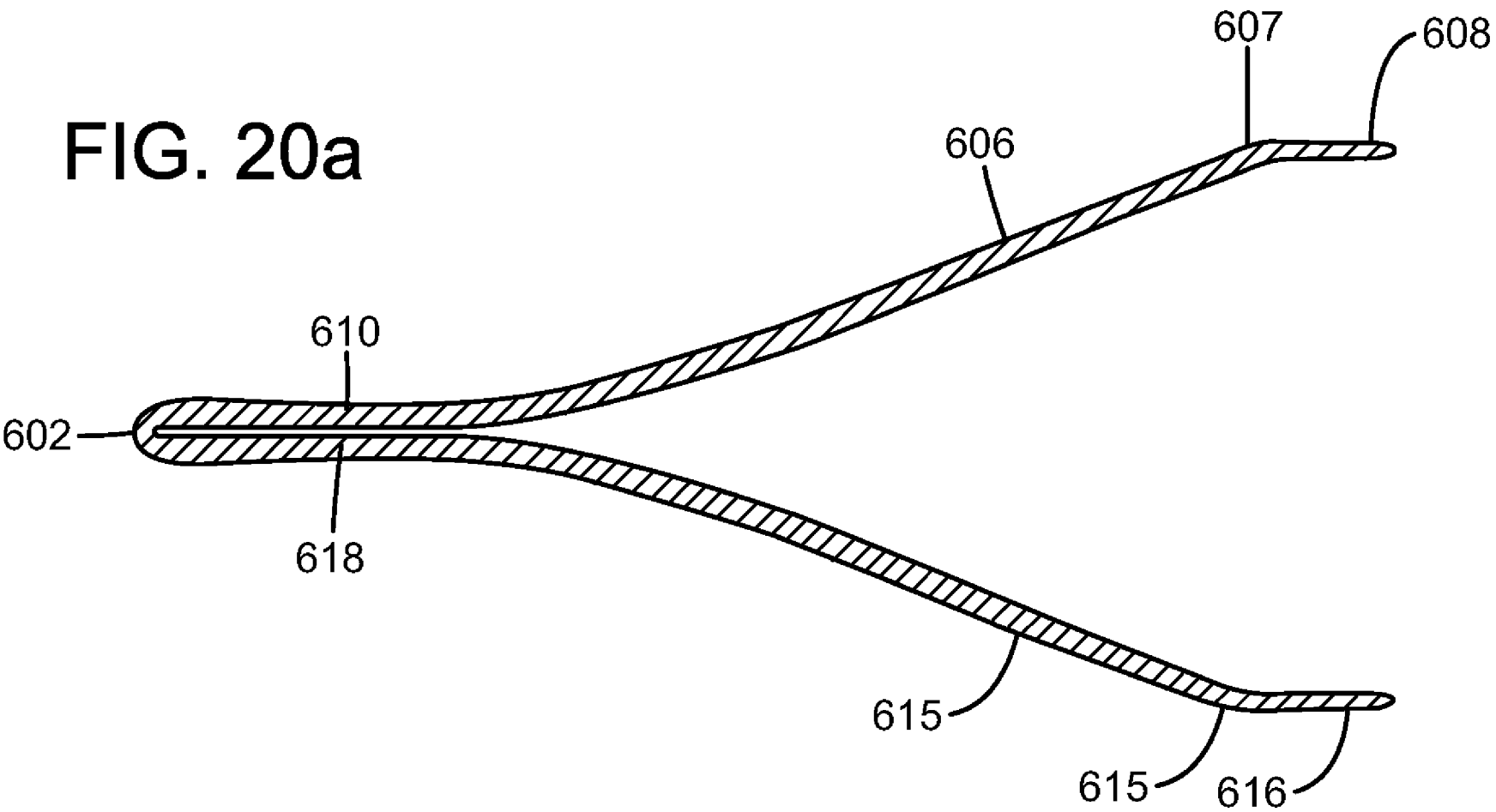
FIGS. 20*a-d* are side views of the insert at progressively higher load.
Figure 20B:
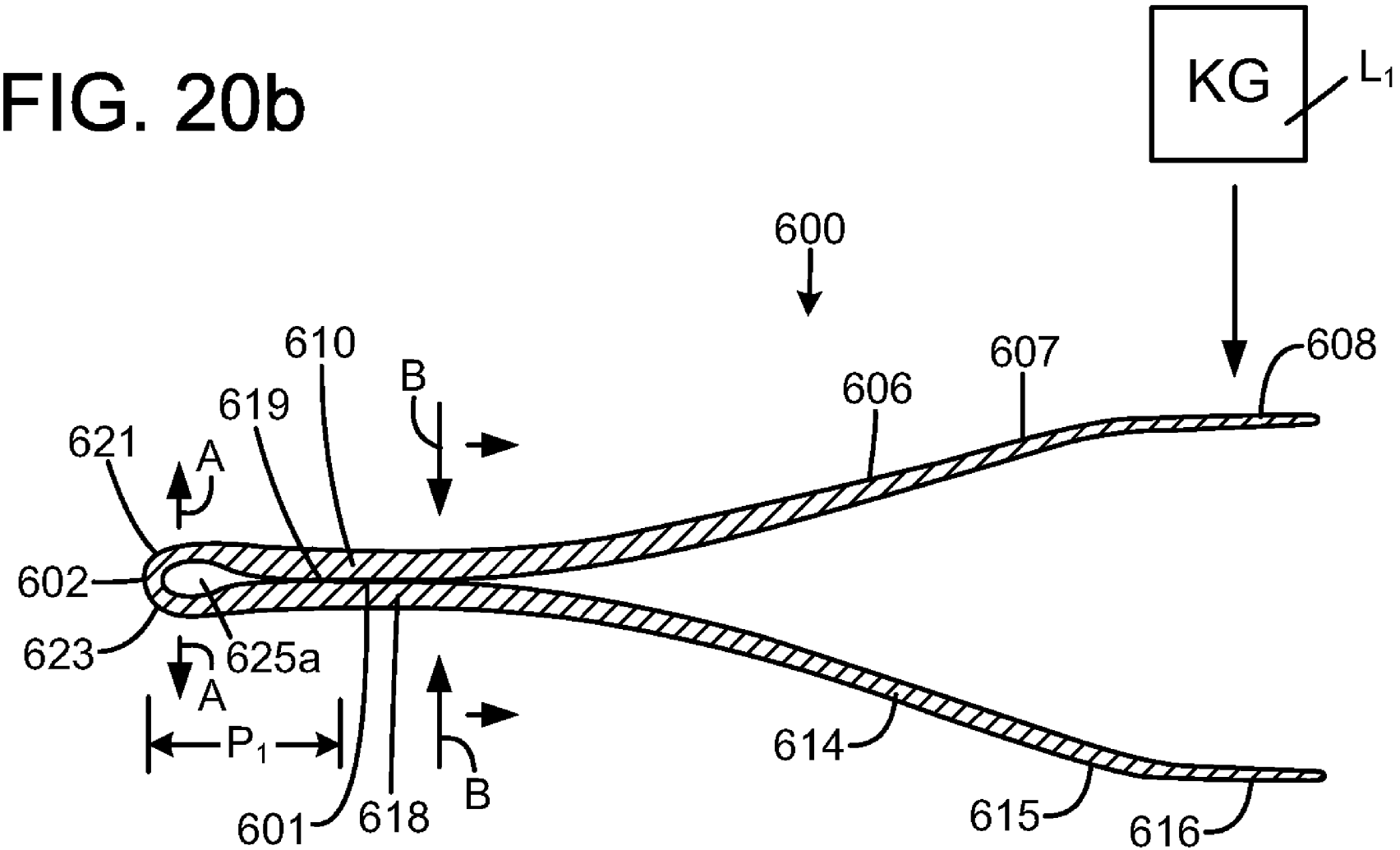

FIGS. 20*a*-20*d* illustrate a progressive wave-shaped shoe spring technique that includes a pull factor, as illustrated by the arrows A, a roll factor, as illustrated by the arrows B, as a weight increases a load L on the upper leg of the shoe insert. More particularly, the shoe insert 600 has an upper leg 606 with a curved convex shaped leg segment 607, terminating at a straight outer rear leg segment 608, and a concave-shaped front leg segment 610. The segment 610 extends to a curved front-end 602 that may be a curved or pointed segment or any other suitable shape and the present invention is not limited to a curved or pointed segment. The insert 600 has a lower leg 614 with a curved convex shaped leg segment 615, terminating at a straight outer rear leg segment 616, and a concave-shaped front segment 618 that is adjacent to the concave upper segment 610. The segment 618 extends to the front end 602. The fibers of the insert 600 may extend from the upper leg 606 around the curved segment 602 front end to the lower leg 614. FIG. 20*a* shows insert 600 without load. The concave-shaped front-leg segment 610 is without contact with the concave-shaped front-leg segment 618. When insert 600 is subject to a light load L1, as shown in FIG. 20*b*, the segment 610 comes into contact with segment 618 to form a contact area 619 that has a center point 601 at a distance p1 from the segment 602. As a result of the load L1, the outer segments 608 and 616 move towards one another while an upper forward segment 621 moves away from a lower forward segment 623, as illustrated by the arrows A, to form a loop 625 behind the front end 602 i.e. the pull factor.

When the load L1 is increased to a load L2, as shown in FIG. 20*b*, the outer segments 608, 616 move even closer to one another and the center point 601 of the contact area 619 moves away to a distance p2 from the front end 602. The distance p2 is greater than the distance p1, i.e. the roll factor. The loop 625*a* increases to a loop 625*b*.

Figure 20C:
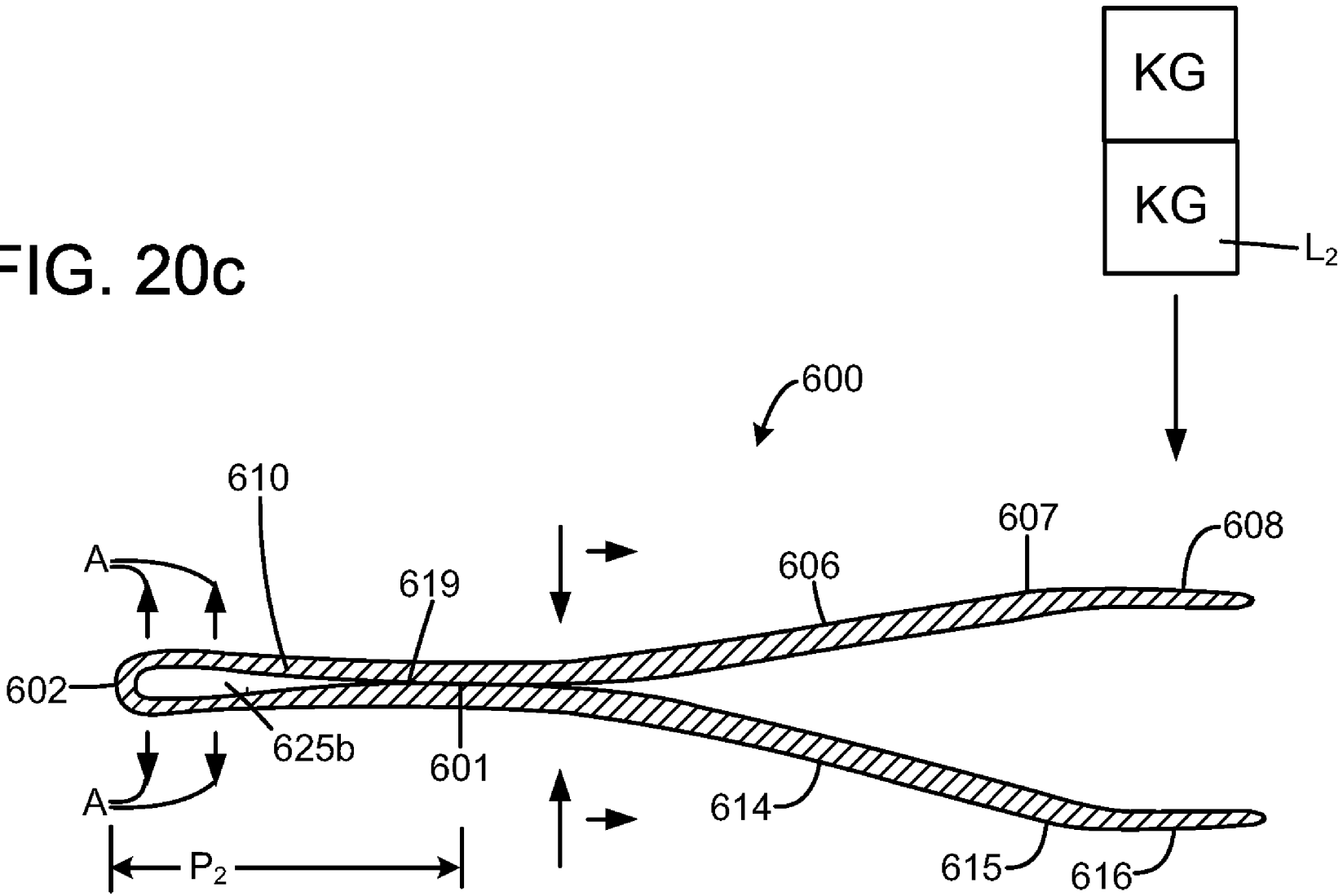
Figure 20D:
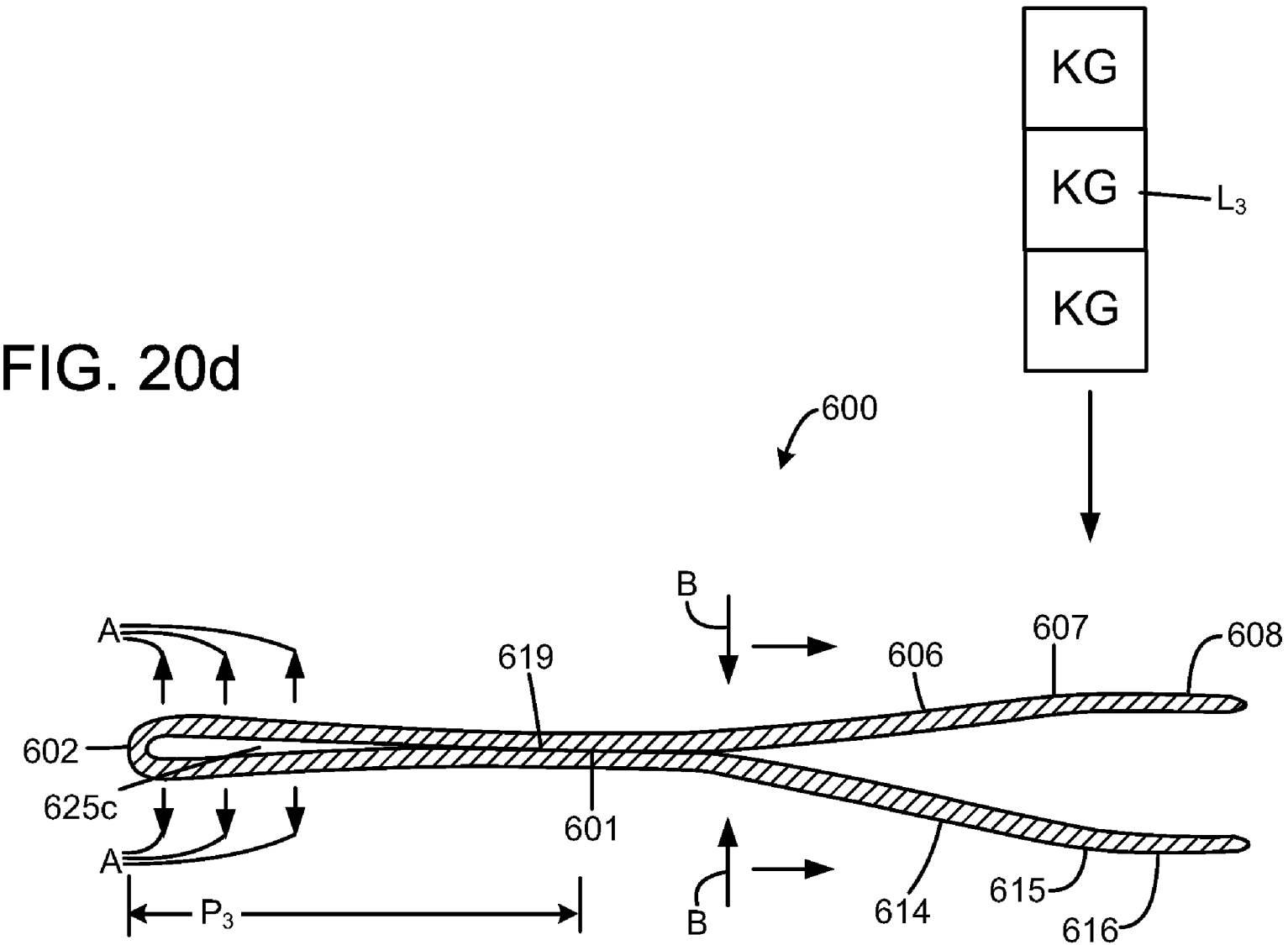

Consequently, when the load L2 is increased to a load L3, as shown in FIG. 20*c*, the outer segments 608, 616 move to a close distance from one another while the contact area 619 rolls forward to create a distance p3 between the center point 601 and the front end 602. The loop 625*b* increases to an elongate loop 625*c*. The pull factor A prevents the insert from being squeezed and eventually crack.

The roll factor B of the moving contact area 619 reduces the stress put on the insert by letting the contact area rolls towards the more hard-wearing rear segments 608, 616 as the load L increases. The roll factor B also makes it progressively harder to press the upper segment 608 towards and into contact with the lower segment 616 since the effective length between the contact area 619 to the outer rear segments is reduced, in turn allowing the insert to manage a wide range of weight without having to adjust neither the hardness nor the softness of the material.

In operation, the first load L1 is put on the straight outer rear leg segment 608 to create the contact area 619 between the front segment 610 and the front segment 618. The segments 621, 623 are pulled away from one another to create a loop 625*a* between the front end 602 and the contact area 619. The center point 601 is at a distance p1 from the front end 602. The upper forward segment 621 thus pull away from the lower forward segment 623 immediately adjacent to the front end 602 to create a loop 625*a*.

The first load L1 is progressively increased to the second load L2 to move the center point 601 from the distance p1 to the distance p2 from the front end 602. The segments 621 and 623 expand the loop 625*a* to a loop 625*b*. The second load L2 is then progressively increased to the third load L3 to move the center point 601 from the distance p2 to the distance p3 from the center point 601. The segments 621, 623 expand the loop 625*b* to a loop 625*c*.

While the present invention has been described in accordance with preferred compositions and embodiments, it is to be understood that certain substitutions and alterations may be made thereto without departing from the spirit and scope of the following claims.

We claim:

1. A method of using a shoe system having a progressively resilient shoe insert, comprising:

providing a shoe-insert having an upper leg and a lower leg connected by a front end, providing the upper leg with an upwardly-facing concave front segment and an upwardly-facing convex rear segment terminating at the front end, providing the lower leg with a downwardly-facing concave front segment and a downwardly-facing convex rear segment, the lower leg forming a mirror-image of the upper leg, putting a first load (L1) on the upper leg, the first load (L1) bending the upper leg and the lower leg and creating a contact area between the upwardly-facing concave front segment and the downwardly-facing concave front segment, the contact area having a center point being a first distance (p1) from the front end, pulling an upper forward segment away from a lower forward segment immediately adjacent to the front end and creating a first loop opening, the first loop opening being defined by the upper forward segment, the lower forward segment, the contact area and the front end connected to the upper forward segment and the lower forward segment, progressively increasing the first load (L1) to a second load (L2) and moving the center point from the first distance (p1) to a second distance (p2) from the front end, the upper forward segment and the lower forward segment expanding the first loop opening to a second loop opening, the second loop opening being defined by the upper forward segment, the lower forward segment, the contact area and the front end connected to the upper forward segment and the lower forward segment, progressively increasing the second load (L2) to a third load (L3) and moving the center point from the second distance (p2) to a third distance (p3) from the center point, and the upper forward segment and the lower forward segment expanding the second loop opening to a third loop opening, the third loop opening being defined by the upper forward segment, the lower forward segment, the contact area and the front end connected to the upper forward segment and the lower forward segment.

2. The method according to claim 1 wherein the method further comprises putting the first load (L1) on a straight outer rear leg segment of the upper leg.

3. The method according to claim 1 wherein the method further comprises expanding the first loop into an elongate shape and gradually moving the contact surface rearwardly towards an upper outer rear leg segment of the upper leg and rearwardly towards a lower outer rear leg segment of the lower leg.

* * * * *